United States Patent [19]

Bishop

[11] Patent Number: 4,580,305

[45] Date of Patent: Apr. 8, 1986

[54] OPTIMUM PRESSURE CONTROL

[75] Inventor: Lewis A. Bishop, Inman, S.C.

[73] Assignee: Milliken Research Corporation, Spartanburg, S.C.

[21] Appl. No.: 638,178

[22] Filed: Aug. 6, 1984

Related U.S. Application Data

[62] Division of Ser. No. 566,673, Dec. 29, 1983, Pat. No. 4,538,432.

[51] Int. Cl.[4] ..... D06B 23/00

[52] U.S. Cl. ..... 8/158; 364/557; 73/170

[58] Field of Search ..... 68/12 R, 177, 178, 184; 8/147, 149.1, 149.2, 149.3, 158; 73/170; 374/143; 364/557, 558

[56] References Cited

U.S. PATENT DOCUMENTS

| | | | |
|---|---|---|---|
| 2,412,188 | 12/1946 | Wolfenden | 68/177 |
| 3,030,791 | 4/1962 | Brown et al. | 68/177 |
| 3,094,858 | 6/1963 | Isley et al. | 68/5 |
| 3,094,859 | 6/1963 | Isley et al. | 68/15 |
| 3,160,896 | 12/1964 | Smith, Jr. | 68/177 X |
| 3,210,970 | 10/1965 | Blount, Jr. | 68/177 |
| 3,297,236 | 1/1967 | Eckerle et al. | 230/17 |
| 3,342,136 | 9/1967 | Domecki | 103/6 |
| 3,501,931 | 3/1970 | Barriquand | 168/177 |
| 3,916,651 | 11/1975 | Carruthers | 68/5 |
| 3,966,406 | 6/1976 | Namiki et al. | 8/179 |
| 4,267,711 | 5/1981 | Kolze | 68/12 R |
| 4,330,081 | 5/1982 | McMillian | 68/12 R X |
| 4,404,625 | 9/1983 | Saito et al. | 68/12 R X |

*Primary Examiner*—Harvey C. Hornsby
*Assistant Examiner*—Frankie L. Stinson
*Attorney, Agent, or Firm*—Earle R. Marden; H. William Petry

[57] ABSTRACT

Pressure control system in which the pressure in a sealed vessel is continuously measured along with the temperature of the treatment fluid to maintain a predetermined pad pressure in the treatment vessel to prevent boil off or flashing of the treatment liquid.

1 Claim, 3 Drawing Figures

OPTIMUM PRESSURE CONTROL

This is a division of application Ser. No. 566.673, filed Dec. 29, 1983, now U.S. Pat. No. 4,538,432.

This invention relates to a system to maintain an optimum pressure in a pressure apparatus for treating textile material in a continuous loop. More particularly, the invention relates to apparatus for the treatment of material under pressure, such as in the dyeing or scouring of a textile material whether woven, knit or non-woven, in which the machine pressure is automatically maintained a proper amount above the vapor pressure of the treating liquid.

It is, therefore, an object of the invention to automatically control pressure in a pressure treatment vessel to prevent boiling and pump cavitation, surging flow and tangles in the material being treated.

Other objects of the invention will become readily apparent as the specification proceeds to describe the invention with reference to the accompanying drawings, in which.

In the treatment of materials in a pressure vessel, such as a dye machine for dyeing of textile materials, the air pressure above the liquid level in the vessel tends to reduce due to air or liquid leaks. When the pressure has reached a pre-determined minimum near the vapor pressure of the liquid in the vessel, the liquid will boil causing cavitation at the pump and surging flow which in turn causes churning of the textile material being dyed and tangled therein. Prior to this invention, the practice was to pre-pressurize the vessel prior to heating of the liquid to desired operating temperatures above 200° F. As pointed out above, the air tends to leak out at some time in the dye cycle resulting in the above-mentioned deficiencies. Therefore, the invention is directed to maintaining a substantially constant true air pressure above the liquid vapor pressure regardless of the air leaks that may occur.

Figure 1:
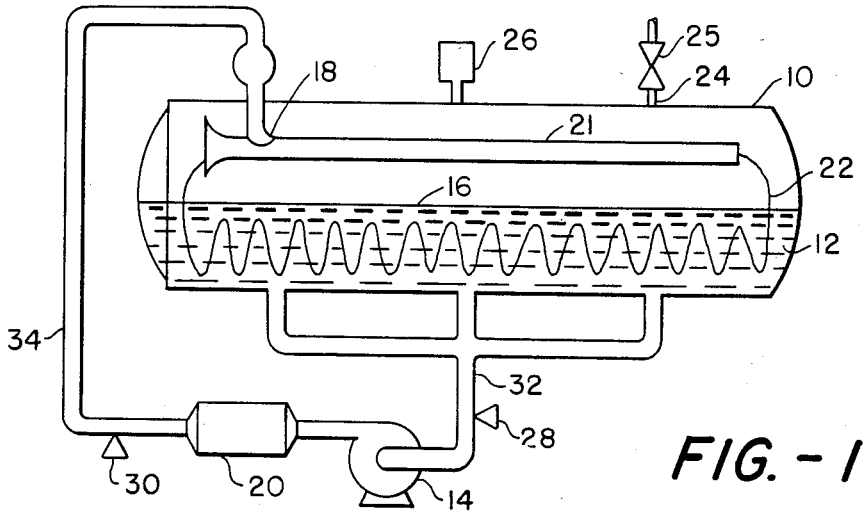
FIG. 1 is a schematic view of one type of pressure dye jet textile material dyeing apparatus.

Looking now to FIG. 1 there is shown a typical pressure dye jet vessel 10 in which dye liquid 12 is circulated by a suitable centrifugal pump 14 to maintain a dye level 16 in the vessel 10. The dye liquid is supplied from the pump 14 to the dye jet 18 through the heat exchanger 20. The dye liquid 12 is ejected through the jet 18 into the fabric transfer tube 21 to carry the fabric 22 to be dyed through the tube 21. The fabric 22 is normally in rope form and travels in an endless path. As shown, the fabric 22 tends to travel in zig-zag form through the dye liquid from the outlet end to the inlet end of the transfer tube 21. For reasons hereinafter explained, the dye vessel 10 is provided with a compressed air inlet conduit 24 having a control valve 25, a pressure sensor 26, and a pair of temperature sensors 28 and 30. Temperature sensor 28 is located in the dye liquid return conduit 32 connected to the suction side of the pump 14 while the temperature sensor 30 is located in the supply conduit 34 to the jet 18 on the downstream side of the heat exchanger 20.

Figure 2:
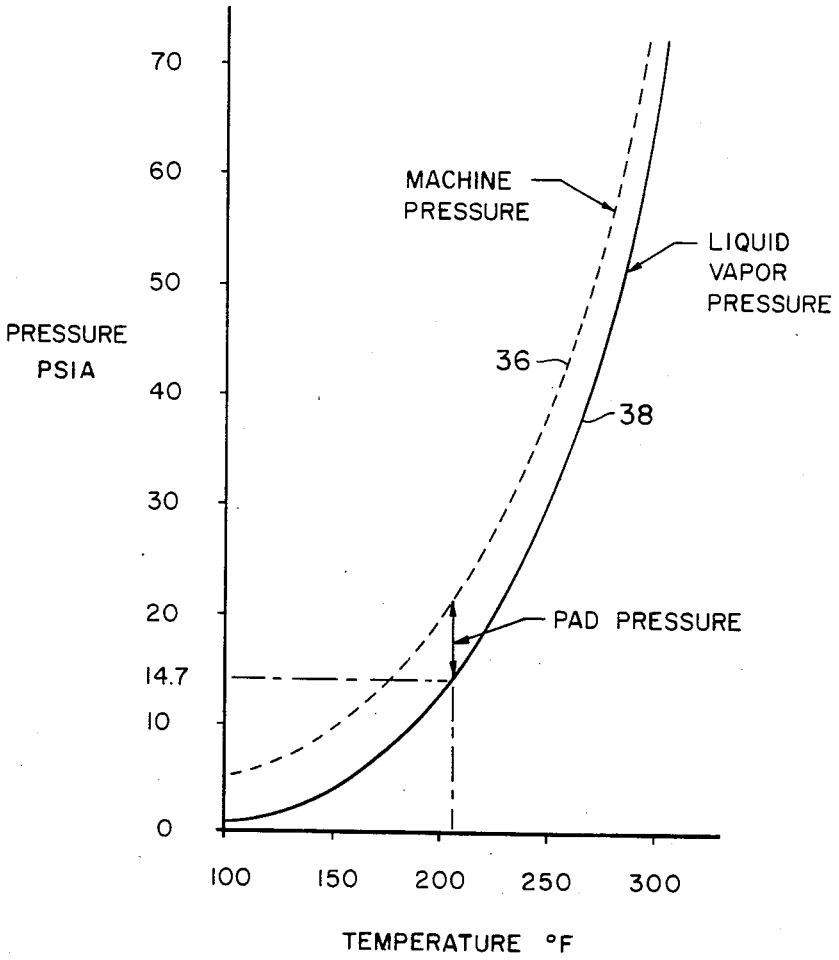
FIG. 2 is a graph showing the interrelation of pressure and temperature in the apparatus of FIG. 1.

FIG. 2 shows a typical vapor pressure curve and the minimum desired machine pressure curve plotted against temperature for a given liquid. Pad pressure will be that pressure difference between the desired machine pressure curve 36 and the vapor pressure curve 38 at a given temperature. In other words:

*MPA* (Machine Pressure Absolute) = *VPA* (Vapor Pressure Absolute) + *PP* (Pad Pressure)

Using the above formula as a guide a lookup table is composed which contains the known vapor pressures for given temperatures and is stored in the EPROM 40 of the computer 42. Then in a manner hereinafter explained, the actual measured temperature and machine pressure are compared to the lookup table in the computer to determine where air is required in the vessel to bring the pressure up to the calculated pressure.

In operation the dye vessel is loaded with fabric 22 and liquid 12 sealed and air under pressure is added, if necessary, to bring the machine pressure up to the calculated amount. Then the liquid temperature is raised to the desired level as the fabric 22 and the liquid 12 is circulated in a closed path through the machine. During the sealed part of the operation of the dye vessel the machine pressure via the sensor 26 and the inlet and outlet temperature of the dye liquid to and from the dye vessel 10 by the temperature sensors 30 and 28, respectively are monitored.

Figure 3:
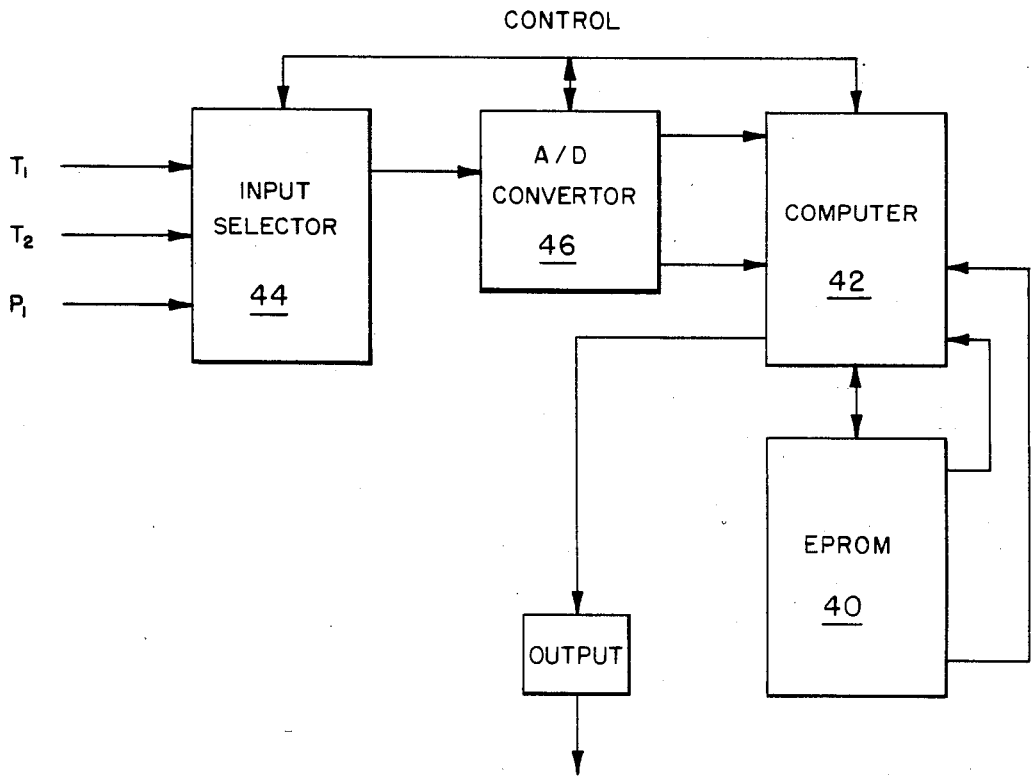
FIG. 3 is a schematic controller block diagram for the pressure vessel shown in FIG. 1.

FIG. 3 represents a microcomputer system to monitor the dye cycle and to maintain the desired pad pressure. The system basically consists of the input selector 44 which sends a selected analog voltage input to the analog to digital convertor 46. The converter converts the selected signal to binary language and sends it to the computer 42. In operation, the temperatures $T_1$ and $T_2$, sensed by the sensors 28 and 30, are sent to the computer 42 and the computer selects the highest of the two and uses the selected temperature as address to access the EPROM 40. The EPROM acts as a look up table and sends a signal to the computer corresponding to the liquid vapor pressure and the computer compares the vapor pressure against the machine pressure $P_1$ as read from the input selector 44 through the converter 46. The computer adds the desired true pad pressure to the vapor pressure and compares this calculation to the machine pressure $P_1$. If the machine pressure $P_1$ is less than the calculated pressure the solenoid valve 25 of the compressed air inlet will be actuated to add air under pressure to the vessel 10. This measuring comparison and control continues constantly along as the machine is sealed. When the machine is not sealed the control circuit is locked out.

Maintenance of the pad pressure in the manner described above prevents the dye liquid from a boiling, which in turn prevents pump cavitation, churning of the dye or treatment liquid and lessens the tendency of the textile material 22 to tangle.

Although I have described in detail the specific embodiment of my invention, I contemplate that changes may be made without departing from the scope or spirit of the invention and it is desired that the invention only be limited by the scope of the claims.

I claim:

1. The method of maintaining a pre-determined pressure in a pressurized liquid treatment vessel comprising the steps of: measuring the temperature of the liquid in the treatment vessel, supplying the measured temperature of the liquid to a computer and calculating the liquid vapor pressure from the measured liquid temperature, measuring the total pressure in the treatment vessel, comparing the calculated vapor pressure to the measured total pressure and automatically supplying air under pressure into the treatment vessel when the pressure differential between the measured total pressure and the calculated vapor pressure is below a pre-determined minimum to prevent flashing of the liquid in the liquid treatment vessel.

* * * * *